United States Patent [19]

Kollberg

[11] Patent Number: 4,495,984

[45] Date of Patent: Jan. 29, 1985

[54] CONTINUOUS CASTING MOLD STIRRING

[75] Inventor: Sten Kollberg, Vësterås, Sweden

[73] Assignee: Asea Aktiebolag, Vësterås, Sweden

[21] Appl. No.: 527,508

[22] Filed: Aug. 30, 1983

Related U.S. Application Data

[63] Continuation of Ser. No. 264,709, May 18, 1981, abandoned.

[30] Foreign Application Priority Data

May 19, 1980 [SE] Sweden ..... 8003695

[51] Int. Cl.[3] ..... B22D 11/10; B22D 27/02

[52] U.S. Cl. ..... 164/468; 164/133; 164/488

[58] Field of Search ..... 164/437, 466, 468, 488, 164/489, 499, 504, 133

[56] References Cited

U.S. PATENT DOCUMENTS

| | | | |
|---|---|---|---|
| 3,153,820 | 10/1964 | Criner | 164/468 X |
| 3,693,697 | 9/1972 | Tzavaras | 164/489 X |
| 3,842,895 | 10/1974 | Mehrabian et al. | 164/466 |
| 4,155,398 | 5/1979 | Trentini et al. | 164/468 |
| 4,158,380 | 6/1979 | Sasaki et al. | 164/468 X |
| 4,200,137 | 4/1980 | Zavaras et al. | 164/489 X |

*Primary Examiner*—Nicholas P. Godici
*Assistant Examiner*—J. Reed Batten, Jr.
*Attorney, Agent, or Firm*—Kenyon & Kenyon

[57] ABSTRACT

During continuous casting, the stream of molten metal poured into the mold is acted on by a static magnetic field so as to split the stream into smaller streams stirring the unsolidified metal in the mold.

2 Claims, 3 Drawing Figures

CONTINUOUS CASTING MOLD STIRRING

This application is a continuation, of application Ser. No. 264,709, filed May 18, 1981, now abandoned.

BACKGROUND OF THE INVENTION

Molten metal, particularly steel, is continuously cast by being poured through the nozzle of either a ladle or an intervening tundish into the top of an open topped continuous casting mold having cooled side walls and containing a body of previously poured molten metal, the metal descending through the mold while solidifying against the mold's side walls so as to form a solidified skin containing unsolidified metal and producing a continuously descending cast strand, the mold having an open bottom through which the strand travels downwardly with its skin still containing some of the unsolidified metal until at some distance below the mold the strand completely solidifies throughout. Thereafter, the strand is cut to lengths which are inspected for surface defects which must be removed by chipping, milling, etc., as required for reheating and rolling of the lengths.

The skin solidifies initially in the upper portion of the mold and gradually increases in thickness with downward movement of the strand forming in the mold, thus forming the strand with an interior representing a sump containing molten metal until at the point where the strand completely solidifies throughout this sump is terminated by a resulting solid front.

The metal poured from the nozzle of either the ladle or the intervening tundish unavoidably contains particles of slag. If the top surface of the molten metal body within the mold is relatively static, it possibly cools so it solidifies enough to form particles of solidified metal. The molten metal necessarily poured from a height above the mold's top is in the form of a stream having at the mold's top portion a velocity typically in the order of from 1 to 1.5 m/sec. The result is that the stream has enough momentum to penetrate the body of molten metal in the mold for substantial distances before losing velocity to a degree where the stream blends into the body of molten metal.

If the molten metal enters the body of unsolidified metal in the mold centrally in the form of a vertical stream, it can possibly penetrate as an internal stream not only the unsolidified metal body in the mold itself but also the unsolidified metal in the sump below the mold where the skin's walls are converging towards each other. The molten metal may be poured from a tundish via a pipe having a lower end submerged in the body of unsolidified metal in the mold and having an open bottom so that the metal is in effect injected as a vertical downward stream, particularly when the mold is contoured to cast a strand of billet or bloom cross section of generally square shape. In the case of a mold having a slab cross section with a width very substantially greater than the thickness, this casting pipe may have a closed bottom and oppositely positioned outlets pointing towards the narrow side walls of the mold, in which case the stream is split into two separate streams traveling towards those narrow walls internally within the body of unsolidified metal in the mold.

It follows that the particles of slag can be via the stream carried to the skin forming within the mold, or possibly adjacently below the mold, so that the particles are entrapped by the solidifying skin-forming metal where the particles remain after the strand completely solidifies so as to form the solid front. Particularly when the two streams are formed by the casting pipe having the opposite side openings, the particles can be driven more or less directly towards and into the solidifying skin inside of the mold. Characteristically the bottom of the casting pipe is positioned not very far below the level of the body of molten metal in the mold so the particles are carried by the streams into the portion of the skin where it is just beginning to form by sollidification and is therefore relatively thin, thus causing the particles to be contained by the finally solidified strand on or near its surfaces. Particles of metal inadvertently solidified at the surface of the molten body in the mold may be drawn downwardly into the forming skin in the mold.

Semi-finished products cut from a solidified strand having a surface containing such particles as surface defects requires processing by undesirably extensive chipping, milling, etc., to remove the defects prior to reheating and rolling. This undesirably adds to the cost of making the final product.

Below the mold and above the solid front of the strand, it is possible to stir the unsolidified metal in the strand by using a multi-phase AC magnetic stirrer positioned outside of the strand so as to induce a traveling multi-phase field in the unsolidified metal which stirs the metal and distributes slag and possibly other particles uniformly so they do not concentrate at any location. It is also possible to use such a stirrer on the outside of the mold itself to in this way stir the molten metal inside of the mold so as to prevent the particles from becoming entrapped by the solidifying skin in the mold. However, a continuous casting mold must have thick water-cooled walls made of heavy copper plates so as to remove the heat from the molten metal and solidify a skin of adequate thickness before the forming strand leaves the mold. The mold walls may characteristically have a thickness of up to 80 mm, and although not solid, these walls make it very difficult for a multi-phase AC traveling field to penetrate them so as to be effective inside of the mold. For example, the effective penetrating field from a typical multi-phase AC stirrer operating even at the low frequency of 1.5 Hz is only from 50–60 mm through solid copper.

It is apparent that the continuous casting art needs some more effective means for splitting up or stirring within the mold the stream or streams of molten metal injected into the body of molten metal to maintain its volume while it with its forming skin is descending through and from the mold.

SUMMARY OF THE INVENTION

According to the present invention, such a more effective means is provided by projecting a stationary magnetic field of constant direction through the mold and into the body of molten metal in the steel and transversely through each stream of molten metal fed into that body to keep it supplied for the formation of the strand leaving the mold's bottom. The field may be supplied by permanent magnetic or electromagnetic means.

In the above way the velocity and momentum of each stream is abruptly reduced, the effect being similar to that of an eddy current brake. With its velocity suddenly reduced, each stream as it pushes against its slowed portion splits or breaks up and stirs into the body of unsolidified metal in the mold so that any particles are distributed substantially uniformly and are not entrapped by the solidifying skin-forming metal which will ultimately become the surface of the finely solidified strand. Below the mold multi-phase AC stirring can be used to continue the stirring.

Preferably the field is formed with an elongated cross section such as in the form of an oblong and which is oriented to form an acute angle with the stream of supply molten metal. This causes the dispersions of the stream to form upwardly towards the upper level of the molten metal in the mold, carrying heat to this area.

Such a field can be projected through the mold walls by DC electromagnetic stirrers positioned on opposite sides of the mold's outside. Such a stirrer can be made somewhat like a multiphase AC coil wound stirrer, but with a core forming two pole pieces and wound for DC operation and, of course, powered by DC. Particularly when the casting pipe has the closed bottom and oppositely pointing side outlets as used for casting a slab strand, two such stirrers can be used on opposite sides of the mold with their pole pieces aligned with each other, the mutually opposite pole pieces of the two stirrers having opposite polarities. With the stirrers appropriately positioned, the two fields are intersected by the two streams of molten metal leaving such a casting pipe. By making the pole pieces with horizontally oriented oblong contours, and because such a casting pipe is normally made to eject the two streams at an angle from the horizontal plane, the result is that the streams flow at acute angles with respect to the resulting two horizontally elongated fields. Because there is no periodic reversal of polarity as in the case of the conventional multi-phase AC field provided by the conventional electromagnetic stirrer, substantially no losses occur by passage of the flux through the copper walls of the continuous castng mold. The mold wall thickness only represents an air gap or gaps insofar as their penetration by the flux field of constant direction. Such a field is sometimes called a static magnetic field but with the present invention it may be desirable under some circumstances to further break up and distribute the stream of supply metal by periodically varying the strength of the flux field but, of course, without changing its direction and with an adequately low frequency as required to preserve the advantages of using a static field.

For the eddy current brake action, the magnetic field must be stationary and capable of carrying the reaction required to slow the velocity and reduce the momentum of the stream in the body of metal in the mold. This is made possible by rigidly positioning the source or sources of the static flux field on the outside of the mold as by anchoring the DC stirrers previously mentioned just as it required in the case of multi-phase AC stirrers. The degree of stirring obtained depends in each instance on the movement of the stream through the static or non-reversing magnetic field. Therefore, the field should be positioned as close as possible to the casting pipe outlet or other source of the stream where the stream's velocity is at its maximum.

BRIEF DESCRIPTION OF THE DRAWINGS

The accompanying drawings are for use in connection with the following detailed description of the invention, the drawings being schematic and the various views being as follows.

DETAILED DESCRIPTION OF THE INVENTION

Figure 1:
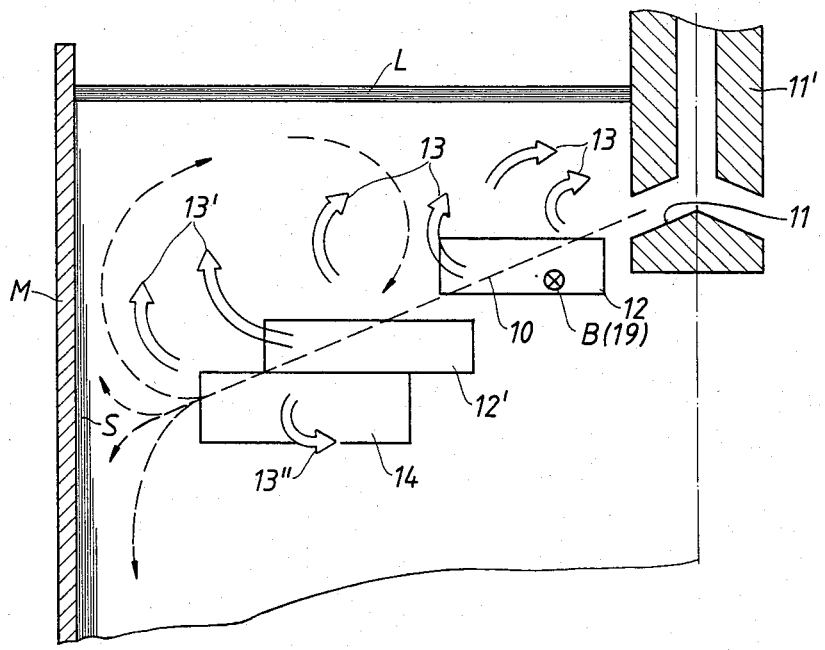
FIG. 1 is a vertical section showing the upper left-hand section of a continuous casting mold of slab cross section and supplied with casting metal via a casting pipe having a closed bottom and oppositely directed side discharge openings pointing towards the narrow or edge walls of the mold.

In FIG. 1 the broken line 10 indicates how without the practice of this invention the supply stream of molten metal leaving the downwardly angled outlet 11 of the vertical casting pipe 11' is injected into molten metal in the mold directly towards the narrow or edge side of the continuous casting mold M of slab cross section and how at this narrow side any slag particles or other particles are driven into the just forming skin S of the solidifying metal, the abrupt stop at the mold side splitting up the stream with minor portions going downwardly and to some extent looping upwardly and around to rejoin the stream moving at high velocity from the outlet 11.

The static magnetic field of the present invention is indicated at 12 positioned immediately at the casting pipe's outlet 11 and of oblong cross section with its long axis extending horizontally and therefore forming an acute angle with respect to the normal downwardly angling direction of the stream as indicated by the broken line 10. In other words, the stream is ejected by the nozzle opening 11 at its highest velocity diagonally with respect to the elongated field 12. The field is shown as being located as close as possible to the outlet 11 of the casting pipe, the result being that as the moving stream goes through the static magnetic field the eddy current brake action is effected, the sudden or relatively abrupt reduction in the velocity of the stream causing the stream to break up into a number of upwardly directed smaller streams 13. The action is one of stirring within the mold itself and because of the acute angle or diagonal relationship between the flowing direction of the stream 10 of the field 12 the stirring action is mainly upwardly. This upward stirring has the advantage of carrying heat to the upper level L of the molten metal bottom which must be maintained within the mold as metal leaves the mold via the cast strand (not shown).

Figure 2:
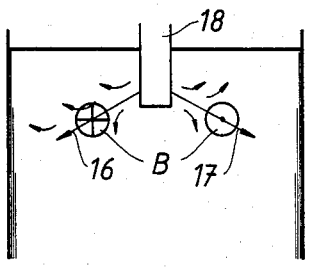
FIG. 2 is a vertical section showing the upper part of a continuous casting mold operating under the above conditions and indicating the opposite direction of the static magnetic fields.
Figure 3:
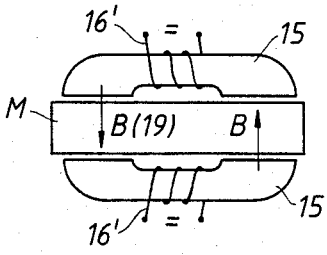
FIG. 3 is a top view showing an example of the construction and arrangement of DC electromagnetic stirrers used in the practice of the invention.

The field 12 can be projected through the wide side of the slab-forming mold M by means of one or more permanent magnets on the outside of the mold. Preferably electromagnets are used as shown by FIGS. 2 and 3 where the static fields B are shown as being diagonally intercepted by the two streams 16 and 17 which are injected into the mold's metal, by electromagnets having cores with pole pieces 15 positioned on opposite sides of the mold M and energized by the DC powered coils or windings 16'. The arrangement should be such that the oppositely positioned pole pieces are of opposite polarity and the pole pieces should have the oblong or horizontally elongated contours required to provide on opposite sides of the casting pipe 11' the horizontal oblong fields of which one is shown at 12 in FIG. 1. The two pole pieces of each core of each electromagnet are, of course, inherently of opposite polarity as indicated by FIG. 2 where the field intersecting the stream 16 is towards the observer while that intersecting the stream 17 is away from the observer.

In the event the single field 12, used on both sides of the casting pipe 11' at its two outlets, is not enough to produce the stirring or stream-splitting action required to prevent the stream from reaching the forming skin S, successive fields of the same kind may be used further along the direction of the stream as indicated at 12' and 14 in FIG. 1, thus producing successively additional stream retardations as indicated by the arrows 13' with possibly some slight downward splitting as indicated by the arrow 13''. Such additional fields may be used to control the stirring effected.

The sudden reduction in the velocity of the stream causes the stream to split mainly upwardly towards the molten body's upper level L and away from the skin S. Any slag particles are continuously stirred uniformly throughout the body of molten metal in the mold, while the upper molten metal level L receives heat to prevent its premature solidification possibly producing solid metal particles. It is important that the first field 12 be positioned close to the outlet 11 of the casting pipe because it is here that the velocity of the stream is at its maximum. The eddy current braking action depends on the velocity of the stream traveling through the static magnetic flux stationarily positioned because the stirrers shown by FIG. 3 are, of course, rigidly mounted to accept the reaction of the braking action. If the successive fields 12' and 14 are used, they should preferably also be horizontally elongated and all of the fields 12, 12' and 14 should be parallel to each other and, therefore, diagonally oriented with respect to the downward angularity of the stream 10. If the direction of the stream is diverted by the action of the first field, following fields should be positioned to intersect the diverted stream. For emphasis, it is repeated that the first and possibly only flux field used should be positioned almost immediately or as close as possible to the outlet 11 of the casting pipe, this applying, of course, also to the other side of the casting pipe where the conditions are the mirror image of those shown by FIG. 1.

With the mold walls water-cooled and made of copper plates as usual, the walls only act as air gaps insofar as their penetration by the static magnetic fields of constant or non-reversing direction are concerned. With the mold of slab contour as shown by FIG. 3, namely having wide sides and narrow edge walls, the static magnetic fields do not have to penetrate a great thickness of the non-solidified metal in the mold or the solidifying skins on the wide sides. Magnetic fields of high intensity are possible.

Under some circumstances it may be desirable to periodically vary the strength of the static fields as by varying the voltage applied to the coils 16' in FIG. 3. If this is done at too high a frequency, the strengths of the fields may be reduced by the copper walls of the mold, but this effect can be avoided if the strength variations are of adequately low frequency. This low frequency will depend on the manner in which the mold is constructed and its dimemsions. These factors must be considered when determining cross section area and intensity of each magnetic field required for stirring effective to avoid each injected stream of supply molten metal from being carried to the narrow sides of a mold of slab contour.

It is particularly in the casting of slab strands that the problem dealt with by this invention is involved. With the wide and relatively thin slab contour a casting pipe having the closed bottom and angularly pointing side outlets is used, making the principles of the present invention of particular value. However, in the case of billets and blooms, the mold cross section is more or less square and an open bottomed casting pipe may be used. This possibly involves the problem that the injected molten metal supply stream extends downwardly into the part of the strand immediately leaving the continuous casting mold's bottom where the use of multi-phase electromagnetic stirring may be undesirable. In such an instance, a static magnetic field projected through the mold so as to be intersected by the descending stream close or at its source will exert a sudden slowing of the stream's velocity with a consequent stirring action.

I claim:

1. A continuous casting mold stirring method for a continuous casting mold of slab cross section having wide side walls and narrow edge walls and containing a body of molten metal maintained by molten metal poured from above the mold through a pipe having a lower end provided with outlets pointing angularly downwardly towards the mold's narrow edge walls and immersed in the upper portion of said body of molten metal so as to inject therein molten metal streams traveling towards the mold's narrow edge walls; wherein the improvement comprises for each of said streams projecting at least one stationary static magnetic field of constant direction through the mold's wide side walls from their outside and into said body and transversely through the stream so as to abruptly reduce the stream's velocity and momentum when in said field with an effect similar to that of an eddy current brake and cause the stream's portion traveling towards said field to push against the stream's portion in said field and split or break up into smaller streams which stir into said body.

2. The method of claim 1 in which said field has an oblong cross section and is substantially horizontal and forms an acute angle with the stream in its field so as to cause said smaller streams to flow upwardly towards the upper level of said body and carry heat thereto.

* * * * *